US006886255B2

(12) United States Patent
Freas et al.

(10) Patent No.: US 6,886,255 B2
(45) Date of Patent: May 3, 2005

(54) FIXED HEAD CLIPPER AND DISPOSABLE BLADE ASSEMBLY

(75) Inventors: Jon Freas, Sterling, IL (US); Jason Long, Morrison, IL (US)

(73) Assignee: Wahl Clipper Corporation, Sterling, IL (US)

( * ) Notice: Subject to any disclaimer, the term of this patent is extended or adjusted under 35 U.S.C. 154(b) by 57 days.

(21) Appl. No.: 10/245,114

(22) Filed: Sep. 17, 2002

(65) Prior Publication Data

US 2004/0049921 A1 Mar. 18, 2004

(51) Int. Cl.[7] ..... B26B 19/02
(52) U.S. Cl. ..... 30/43.91; 30/200
(58) Field of Search ..... 30/223, 43.91, 30/43.92, 220, 218; D28/53

(56) References Cited

U.S. PATENT DOCUMENTS 3,521,093 A * 7/1970 Harms ..... 310/19
3,747,212 A * 7/1973 Krayl ..... 30/221
3,999,295 A * 12/1976 Du Bois ..... 30/195
4,381,603 A * 5/1983 Schreiber et al. ..... 30/43.92
4,700,476 A 10/1987 Locke et al. ..... 30/43.91
5,068,966 A * 12/1991 Wahl et al. ..... 30/43.2
5,579,581 A 12/1996 Melton ..... 30/223
5,606,799 A 3/1997 Melton ..... 30/216
6,502,312 B2 * 1/2003 Beutel et al. ..... 30/216
6,505,404 B2 * 1/2003 Ullmann ..... 30/216

* cited by examiner

*Primary Examiner*—Charles Goodman
(74) *Attorney, Agent, or Firm*—Greer, Burns & Crain, Ltd.

(57) ABSTRACT

A hair clipper includes a handle portion having a drive end with a first coupler formation, and a blade assembly. The blade assembly includes a housing at least partially enclosing a reciprocating blade and a fixed blade, and having a top, bottom, and at least two sides joining the top and bottom. Integrally joined to and extending away from the bottom of the housing is a second coupler formation for engaging the first coupler formation. The first and second coupler formations form a releasable connection which inhibits movement of the blade assembly with respect to the handle portion when the two coupler formations are engaged.

24 Claims, 7 Drawing Sheets

FIXED HEAD CLIPPER AND DISPOSABLE BLADE ASSEMBLY

BACKGROUND OF THE INVENTION

The present invention relates to electric hair clippers, trimmers, and shavers, and more specifically to such devices having fixed blade assemblies which are stationary in use, but detachable relative to the clipper handle.

Disposable manual razors and electric clippers are conventionally used to cut and clip hair for home use, and for the removal of a patient's hair prior to surgery. The razor has a sanitary advantage of being completely disposable, while providing generally stubble-free skin after use. The razor, however, can cause undesirable nicks which, when occurring during pre-operative shaving, may contribute to post-operative infections. Electric clippers are often preferred, therefore, for surgical use. The electric clippers can quickly clear an operation site of a majority of unwanted hair to improve visibility, and without exposure to infections.

FIG. 1 illustrates a conventionally available electric clipper 10. The clipper includes two main components: a combined handle and drive system 12, and a removable, disposable blade assembly 14. The blade assembly 14 includes a housing 16 enclosing a fixed blade 18 and a moving blade 20 coaxially reciprocating relative to the fixed blade 18. When used in medical applications, the blade assembly 14 is typically packaged in a sealed bag for sterility. Just prior to surgery, a hospital technician opens the bag and attaches the blade assembly 14 to the handle/drive system 12. Upon completion of a shaving operation, the blade assembly 14 is removed and discarded.

The blade assembly housing 16 has a flat and rectangular top portion (not shown), from which extend four side portions 24. The four side portions 24 surround an opening 26 of the handle/drive system 12. The blade assembly 14 is pressed by the technician to slide onto the handle/drive system 12, and notches 28 in two opposing sides of the housing 16 then lockingly engage opposing tabs 30 in the handle/drive system 12 to create a "snap" fit. To fit the blade assembly 14 on the handle/drive system 12, the technician typically must hold the handle/drive system 12 with one hand, while gripping the blade assembly 14 with at least two fingers of the other hand.

One disadvantage of this conventional clipper unit 10 is the difficulty in properly engaging the blade assembly on the handle so that a drive member 32, normally a rotating eccentric cam member or reciprocating drive finger, will properly engage a cam follower (not shown) in the reciprocating blade 20 of the blade assembly 14. Such units require the user to often perform relatively complicated multiple alignment and engagement steps to properly mount the blade assembly 14, which can be a frustrating and time consuming procedure.

Another disadvantage of this conventional surgical clipper 10 is that the side portions 24 are very short relative to the blade assembly 14. When sliding the blade assembly 14 onto the handle/drive system 12, the technician is required to place his or her fingers very near the blades 18, 20 of the assembly 14 to exert appropriate pressure, causing the fingers to often contact the exposed teeth of the blades 18, 20. Even when not in operation, upon such contact, the sharp blade teeth may puncture or rupture a thin surgical glove typically worn by a technician performing surgical procedures, thus ruining the sterile environment created by the glove, and possibly infecting the technician with potentially infectious material which may be transmitted by the patient. This potential for infection becomes even greater if the sharp teeth. break the skin of the technician's fingers. Additionally, where a sterile environment is required, the blade assembly must be discarded and replaced before use when the blades contact the technician's skin, which can lead to increased cost from wasted blade assemblies.

Still another disadvantage of this clipper 10 is the significant size of the opening 26 of the handle/drive system 12 which engages the housing side portions 24 of the blade assembly 14. For this configuration, the handle opening 26 must have the same general area as the housing top portion 22. Where a larger surface area of contact is desired for the top portion 22, the size of the handle 12 must therefore be increased to accommodate the area of the top portion 22. The larger the size of the handle 12 though, the more cumbersome the clipper 10 becomes, and the more difficult it becomes to maneuver the blade assembly 14 to shave recessed or contoured portions of the body.

Another surgical clipper with a detachable blade assembly is presented in U.S. Pat. No. 4,700,476 to Locke et al., and shares the same general features as the above-described conventional clipper. The blade assembly housing of this clipper also slides onto the handle/drive system, but instead locks into place under wings that extend from the tip of the drive system about the oscillating member. The oscillating member of the drive system thus engages the drive member of the blade assembly within the blade assembly housing.

This clipper configuration also has the disadvantage, described above, of requiring two hands for assembly and detachment. The similar low profile of its housing and sliding engagement features, also require the technician to push the blade assembly onto the handle from the direction of the blades, often bringing the technician's fingers in direct contact with, and/or pressure from, the sharp blade teeth which, as noted above, can lead to undesirable consequences.

A third known clipper with a detachable blade assembly is shown in U.S. Pat. No. 5,606,799 to Melton. The blade assembly of this clipper is movable and rotatable about the handle portion while in use, and may be easily attached and removed by the operator or technician with only one hand, while avoiding contact of the sharp blade teeth with the technician's fingers. The present inventors have discovered that for some applications, however, it is more desirable to have the blade assembly fixed relative to the handle while in use.

SUMMARY OF THE INVENTION

Accordingly, the present invention provides a hair clipper having a detachable and disposable blade assembly which is fixed relative to a handle portion of the clipper while in use, is readily engaged upon the handle portion for quick and easy engagement, and has a pop-off tab feature which permits the used blade assembly to be easily ejected from the handle portion with one hand without the operator touching the blades. Additionally, the large surface area of the contacting surface of the blade assembly housing facilitates accurate control over the unit's cutting angle, whether applied against the skin or against a hair comb.

More specifically, the present invention provides a hair clipper including a handle portion having a drive end with a first coupler formation, and a blade assembly. The blade assembly includes a housing at least partially enclosing a reciprocating blade and a fixed blade, and having a top, bottom, and at least two sides joining the top and bottom.

Integrally joined to and extending away from the bottom of the housing is a second coupler formation for engaging the first coupler formation. The first and second coupler formations form a releasable connection which inhibits movement of the blade assembly with respect to the handle portion when the two coupler formations are engaged.

In another embodiment, a disposable blade assembly for use with a hair clipper is provided, the clipper including a handle with a drive end, a drive member extending from the drive end, and a coupler formation disposed at the drive end. The blade assembly includes a housing having a top, bottom, at least two sides joining the top and bottom, and a blade locator disposed on the inside of the housing top. A fixed cutting blade engages the blade locator, and a movable cutting blade is also provided for reciprocal linear movement relative to the fixed cutting blade. A shroud formation defines a recess for accommodating the drive member. The recess has a first opening integrally connected to a central opening in the housing bottom, and a second opening opposed to the first opening, which engages the coupler formation of the drive member. A cam follower is also provided for engaging the drive member through the first opening in the shroud formation. The cam follower exerts a biasing force on the fixed and movable cutting blades either by its own configuration, or in conjunction with a separate clip. The recess of the shroud formation also has an irregular shape which restricts movement of the engaged coupler formation.

DETAILED DESCRIPTION OF THE PREFERRED EMBODIMENT

Figure 1:
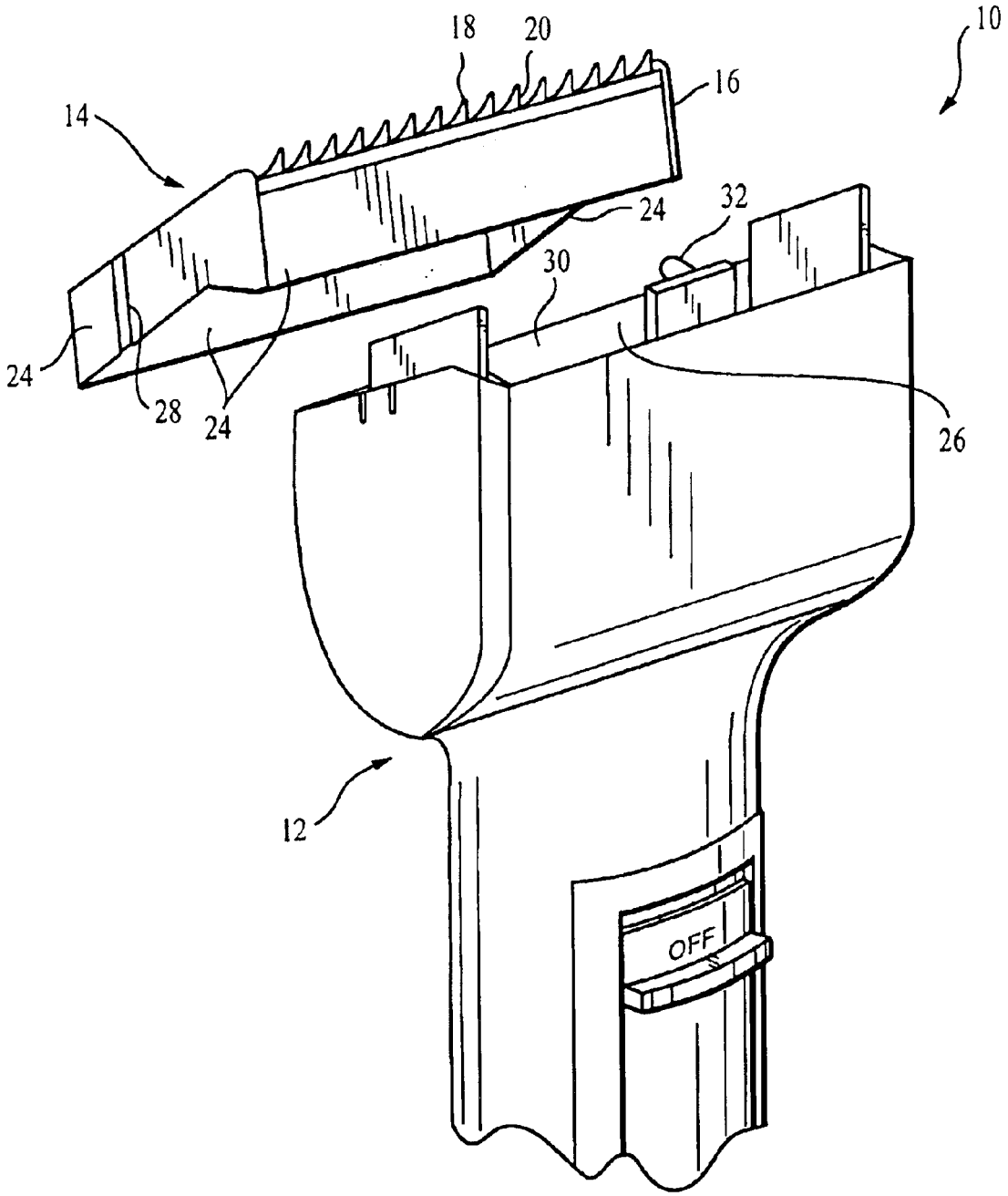
FIG. 1 PRIOR ART
FIG. 1 is a top perspective elevational view of a hair clipper incorporating the detachable blades of the invention.
Figure 2:
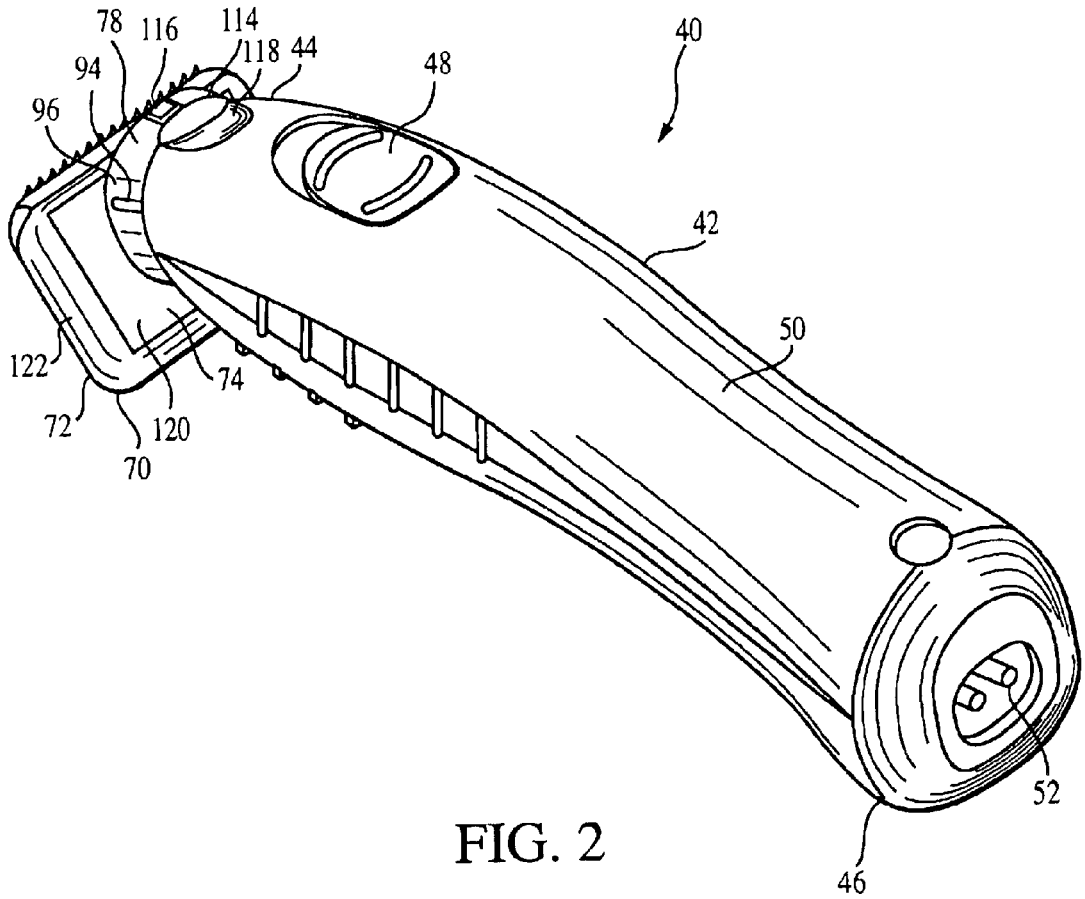
FIG. 2 is a top perspective elevational view of a hair clipper incorporating the detachable blade assembly of the present invention.
Figure 5:
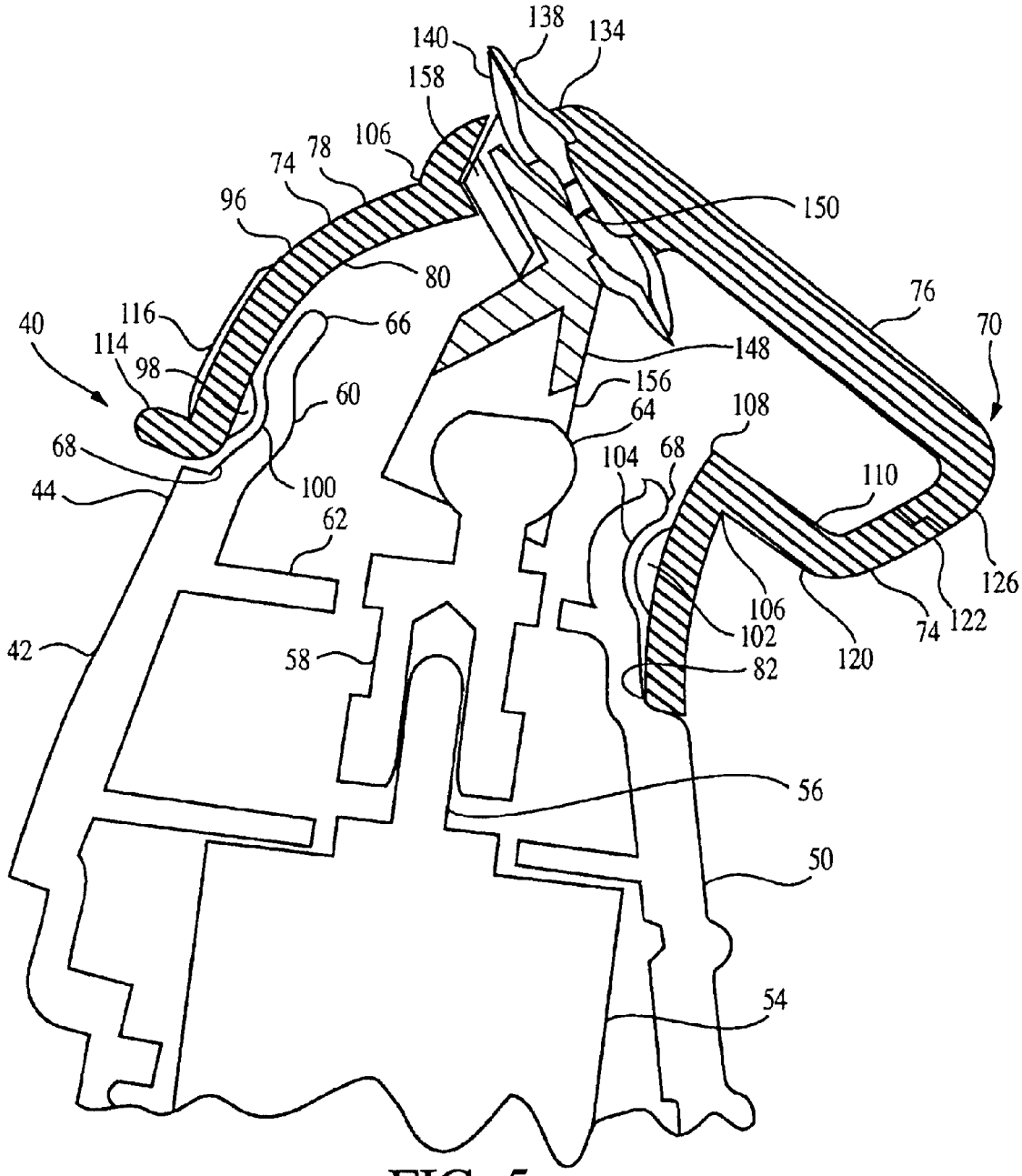
FIG. 5 is a sectional view taken along the line 5—5 of FIG. 4 and in the direction indicated generally, and also including a fragmentary sectional view of the handle portion shown in FIG. 2.
Figure 6:
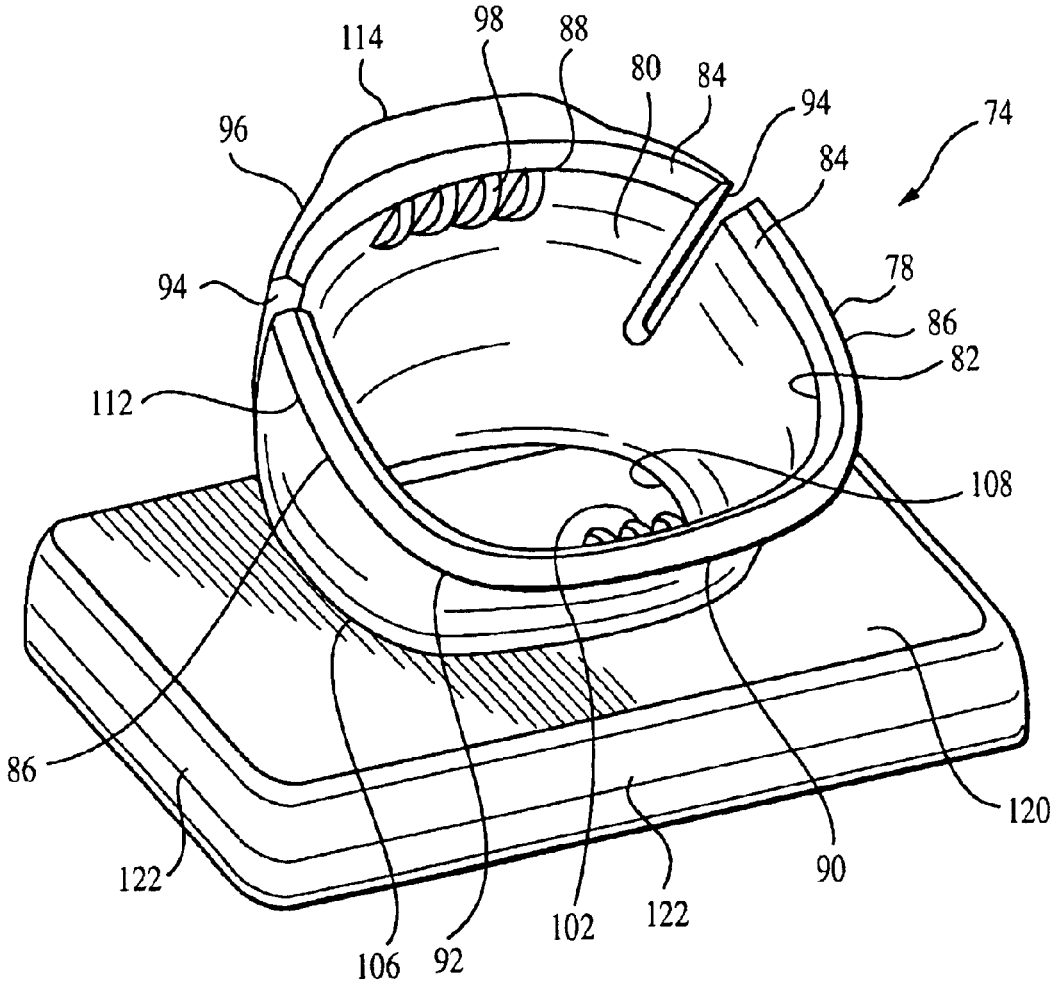
FIG. 6 is an oblique perspective elevational view of the housing portion of the detachable blade assembly of the present invention.
Figure 7:
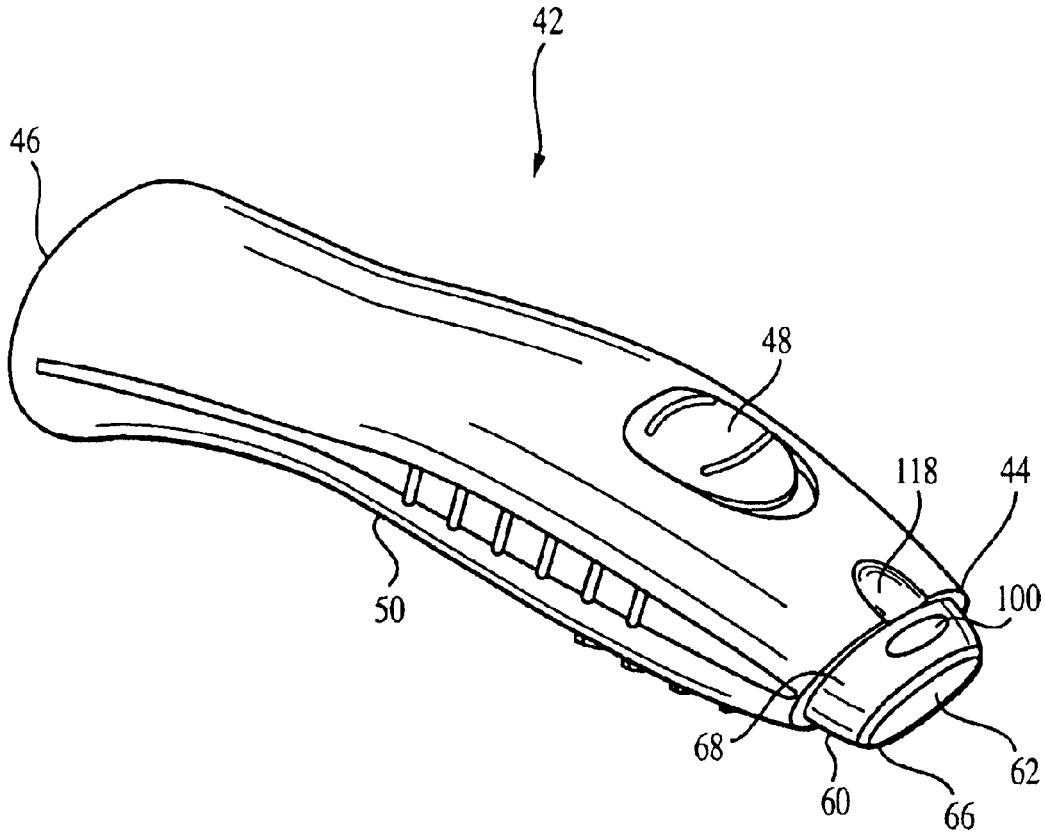
FIG. 7 is a top perspective elevational view of the handle portion to the clipper depicted in FIG. 2.

Referring now to FIGS. 2, 5 and 7, an electric hair clipper of the type suitable for use in the present invention is generally designated 40, and includes a motorized handle portion 42 having a drive end 44, a recharge end 46 opposite the drive end 44, and a switch 48 located therebetween. More specifically, the handle portion 42 includes a housing 50 preferably made of durable, impact-resistant molded polymeric or plastic material as is known in the art.

Enclosed by the housing 50 is a power source (not shown) which, in the preferred embodiment, is one or more rechargeable batteries, however disposable batteries, or an electric transformer with a power cord connected to an electrical wall outlet, are also contemplated. In the preferred embodiment, terminals 52 for engaging a recharger (not shown) are located at the recharge end 46.

As can best be seen in FIG. 5, connected to the power source in a known manner is an electric motor 54 which is secured within the housing 50, electrically connected to the switch 48 (FIG. 2). The motor 54 has a drive shaft or armature 56 secured to an offset cam eccentric 58. The arrangement and operation of the motor 54, the power source, and the cam eccentric 58 are similar to components which are well known in the art and are described in detail in commonly assigned U.S. Pat. No. 5,068,966, which is incorporated by reference herein.

At the drive end 44 is provided a first coupler formation 60 which defines a cavity 62 into which projects the cam eccentric 58 and a lobe or spherically shaped drive actuator member 64. The first coupler formation extends from the drive end 44 and terminates in an engagement opening 66. An outer dimension 68 of the first coupler formation 60 is preferably shaped to conform to the shape of the drive end 44, but dimensioned smaller than the drive end 44 enough to create a substantially flush outer fit with a blade assembly 70, described below. More preferably, the outer dimension 68 is larger where it contacts the drive end 44, and tapers to a smaller size upon reaching the engagement opening 66 (best seen in FIG. 7). The tapered shape allows for easier engagement with the blade assembly 70, as also described below.

The actuator member 64 is preferably fixed upon the cam eccentric 58, and more preferably machined to be a single piece with the cam eccentric 58. It is contemplated that any equivalent method of attaching a ball to orbit about the centerline of a motor shaft may be also suitably employed.

Referring now to FIGS. 2–6, included with the clipper 40 is a blade assembly, generally designated 70, which is made up of a blade assembly housing 72 preferably having a first housing portion 74 and a second housing portion 76. The first housing portion 74 includes a second coupler formation or shroud 78 which is shaped to accommodate the first coupler formation 60 within a recess 80. The recess 80 defines the inside of the second coupler formation 78 and is preferably internally dimensioned to provide a substantially snug fit with the first coupler formation 60 when the first and second coupler formations are fully engaged.

The second coupler formation 78 has a first shroud opening 82 through which the first coupler formation enters for engagement. The first shroud opening 82 preferably includes an internal beveled edge 84 (best seen in FIG. 6) to more readily guide the engagement opening 66 of the first coupler formation into the recess 80 of the second coupler formation 78. In the preferred embodiment, the outer dimension 68 of the engagement opening 66 is also rounded or beveled to further facilitate a more easily guided engagement.

The recess 80 is also preferably tapered in the same direction as, and complimentary to, the entire outer dimension 68 of the first coupler formation 60, such that the engagement opening 66 of the first coupler formation 60 is significantly smaller than the first shroud opening 84 of the second coupler formation 78. This size difference allows an operator or technician to easily insert the, first coupler formation into the second coupler formation without requiring significant locating effort. The generally matching tapers of the first and second coupler formations serve to self-align the handle portion 42 with the blade assembly 70 as the first coupler formation 60 is further pressed into the recess 80 until fully engaged. Although the tapered shapes of the outer dimension 68 and recess 80 are preferred, straighter and non-tapered shapes are also contemplated.

Figure 4:
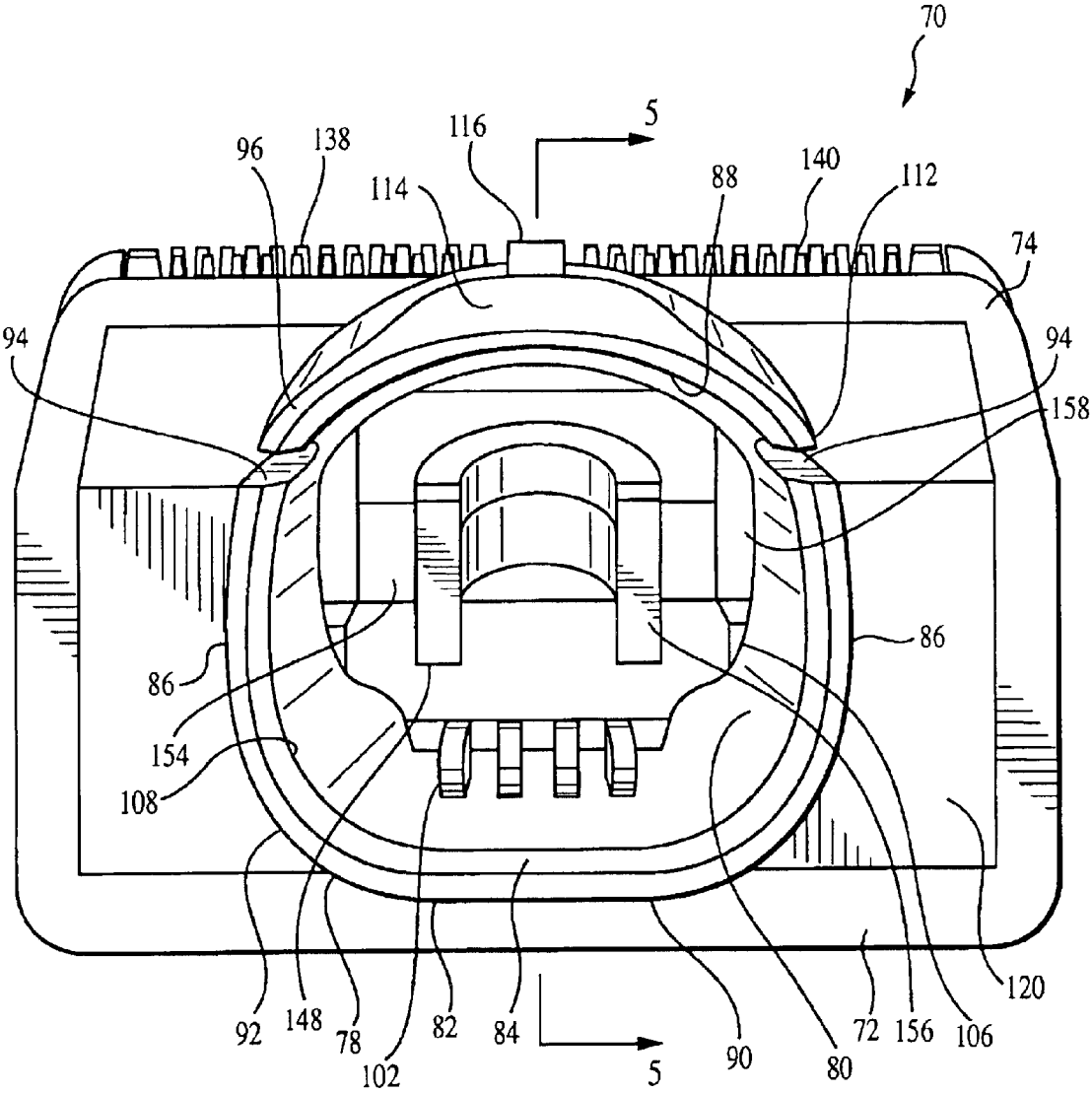
FIG. 4 is a rear end view of the blade assembly depicted in FIG. 3.

In the preferred embodiment, the first shroud opening 82 has the shape of a rounded rectangle, or squared oval, which has flatter portions 86, 88, 90 and rounder portions 92 between adjacent flatter portions (best seen in FIG. 4). The flatter portions 86, 88, 90 serve to both guide the first coupler formation 60 into a properly aligned position during engagement, as well as to prevent rotational movement of the first coupler formation 60 within the second coupler formation when fully engaged. The rounder portions 92 serve to further facilitate easy movement and engagement of the first coupler formation 60 into the second coupler formation 78. It is therefore preferred that this flatter/rounder construction continue throughout the length of the recess 80 of the second coupler formation shroud 78.

Although the male-female configuration of the first and second coupler formations 60, 78 described above is preferred, one skilled in the art is apprised that either of the first and second coupler formations 60, 78 may be located on either of the blade assembly 70 or the drive end 44. In other words, it is also contemplated that the clipper 40 may be configured such that a coupler formation of the blade assembly 70 may be shaped to fit inside the cavity 62 of the handle portion 42, without departing from the present invention.

To prevent unintended disengagement of the first coupler formation 60 from the second coupler formation 78, in the preferred embodiment, the second coupler formation 78 is provided with a biasing force with which it grips the first coupler formation 60, and which biasing force may be overcome when the blade assembly 70 is intended to be disengaged from the coupler formation 60 of the handle portion 42. The biasing force is provided by at least one, and preferably two, notches 94, which define at least one spring-biased tab 96 in the second coupler formation 78. Although two notches 94 are preferred, it is contemplated to add more to create multiple spring-biased tabs 96.

To facilitate the biasing force, the second coupler formation 78 is preferably made of a relatively more resilient plastic material, and/or is constructed to have a lower spring rate, while the formation 60 is more rigid either through material selection or component construction as is known in the art. It is, also contemplated that the relative flexibility of the formations 78 and 60 may be reversed. In the preferred embodiment, the outer dimension 68 of the first coupler formation 60 should be of a size such that, when fully engaged with the second coupler formation 78, the biasing force from the spring-biased tab 96 should remain relatively constant.

In addition to the biasing force, disengagement of the first and second coupler formations is preferably further limited by a first protrusion 98 integrally formed on the interior recess 80 portion of the tab 96. The first protrusion 98 can be a single protrusion, or more preferably a series of protrusions (best shown in FIGS. 5 and 6), and is configured to contact the outer dimension 68 of the first coupler formation 60. In the preferred embodiment, the outer dimension 68 also includes a first groove 100 (best seen in FIGS. 5 and 7), shaped to receive the first protrusion 98. The first protrusion 98 is held into the first groove 100 by the biasing force, and the protrusion 98 is preferably formed to be centered within the groove 100 when the first and second coupler formations are fully engaged.

In the preferred embodiment, a second protrusion 102 is also formed within the recess 80, but along the flatter portion 90 opposite to the first protrusion 98 and tab 96 (best seen in FIGS. 4 and 5). A second groove 104 is preferably formed in the outer dimension 68 of the first coupler formation 60 opposite to the first groove (best seen in FIG. 5). The protrusion 102 can be a single protrusion, or more preferably a series of protrusions, and is also preferably configured to be centered within the groove 104 when the first and second coupler formations are fully engaged.

In this preferred configuration, the first and second coupler formations are thus held, together by the strength of the biasing force directed from at least two opposite directions by protrusion and groove combinations. Full engagement of the first coupler formation 60 with the second coupler formation 78 is thus defined in the preferred embodiment when the protrusions 98, 102 are locked into (fully centered within) their respective grooves 100, 104, thereby providing a snap fit of the first coupler formation into the second coupler formation.

Although the two opposing protrusion/groove combinations described above are preferred, it is contemplated to provide several additional protrusions spaced around, the internal recess 80, and joined to respective counterpart grooves in the outer dimension 68. It is even contemplated to have one continuous protrusion ringing the entire recess 80 and joining to one continuous groove ringing the outer dimension 68. One skilled in the art is also apprised that protrusions may be formed on the outer dimension 68 to join to grooves located in the shroud recess 80 without departing from the present invention.

At a base end 106 of the second coupler formation 78 is defined a second shroud opening 108 opposing the first shroud opening 82, and in communication with an interior 110 of first housing portion 74 (best seen in FIG. 5). The base end 106 and first housing portion 74 are integrally connected, and the second coupler formation 78 and first housing portion 74 are preferably formed as a single unit, and of the same material. It is also contemplated that the shroud 78 may be a separate unit joined to the first housing portion 74 by adhesive, sonic welding, locking snap fit, or any other joining technique known in the art.

Opposite the base end 106, the first shroud opening 82 includes an outer rim 112 and preferably at least one extending release tab 114 integrally joined to the outer rim 112. In the preferred embodiment, the release tab 114 is constructed and arranged to be large enough to be engaged by an operator's thumb. Force exerted by the operator's thumb against the release tab 114 in the direction indicated by an arrow 116 (best seen in FIG. 2), works against the biasing force, and works to sufficiently lift the first protrusion 98 out of the first groove 100 to allow disengagement of the blade assembly 70 from the handle portion 42. In the preferred embodiment, a thumb contour 118 is formed into the handle portion 42 where the drive end 44 meets the engaged release tab 114 (best seen in FIGS. 2 and 7), which allows greater leverage from the operator's thumb against the release tab 114, without requiring the tab to extend farther from the shroud outer rim 112.

As force is exerted against the release tab 114 in the direction of arrow 116, flatter portion 90 at the outer rim 112 of the first shroud opening 82 may act as a hinge point for disengagement of the blade assembly 70 from the handle portion 42. The flatter portion 88 therefore may have a more rounded shape than flatter portion 90 to increase the hinge effect, thereby providing greater control by the operator to easily direct the disengaging blade assembly 70 away from the operator as it pops off the handle portion 42. Also, even a slightly different shape to the opposing flatter portions 88 and 90 can prevent the blade assembly 70 from being engaged backwards upon the handle portion 12.

In the preferred embodiment, the first and second coupler formations are configured such that, except for the release tab 114 and thumb contour 118, the outer rim 112 should form a substantially flush fit where it meets the handle housing 50 at the drive end 44 (best seen in FIG. 5). The flush fit allows for an easy and fast, location of the release tab 114 to disengage the blade assembly 70 from the handle portion 42. An additional preferred feature is that the arrow 116 is integrally molded onto the second coupler formation 78 to serve as a permanent indicator.

Referring now to FIGS. 3–6, the first housing portion 74 includes an upper surface 120 to which the base end 106 of the second coupler formation 78 is attached, and a depending skirt wall 122. The second housing portion 76 has a substantially planar floor 124 with an upstanding peripheral wall 126 on three sides, 128, 130, and 132 (best shown in FIG. 3). The peripheral wall 126 is constructed and arranged to be fixed to opposing portions of the depending skirt 122 using chemical adhesive, ultrasonic or RF welding, or other suitable attachment technologies. One feature of the present blade assembly 70 is that the floor 124 has a lower surface with a significant surface area with which to contact the subject's skin and/or to contact a hair comb, depending on the application. In this manner, guidance is provided to the operator for hair clipping purposes.

Figure 3:
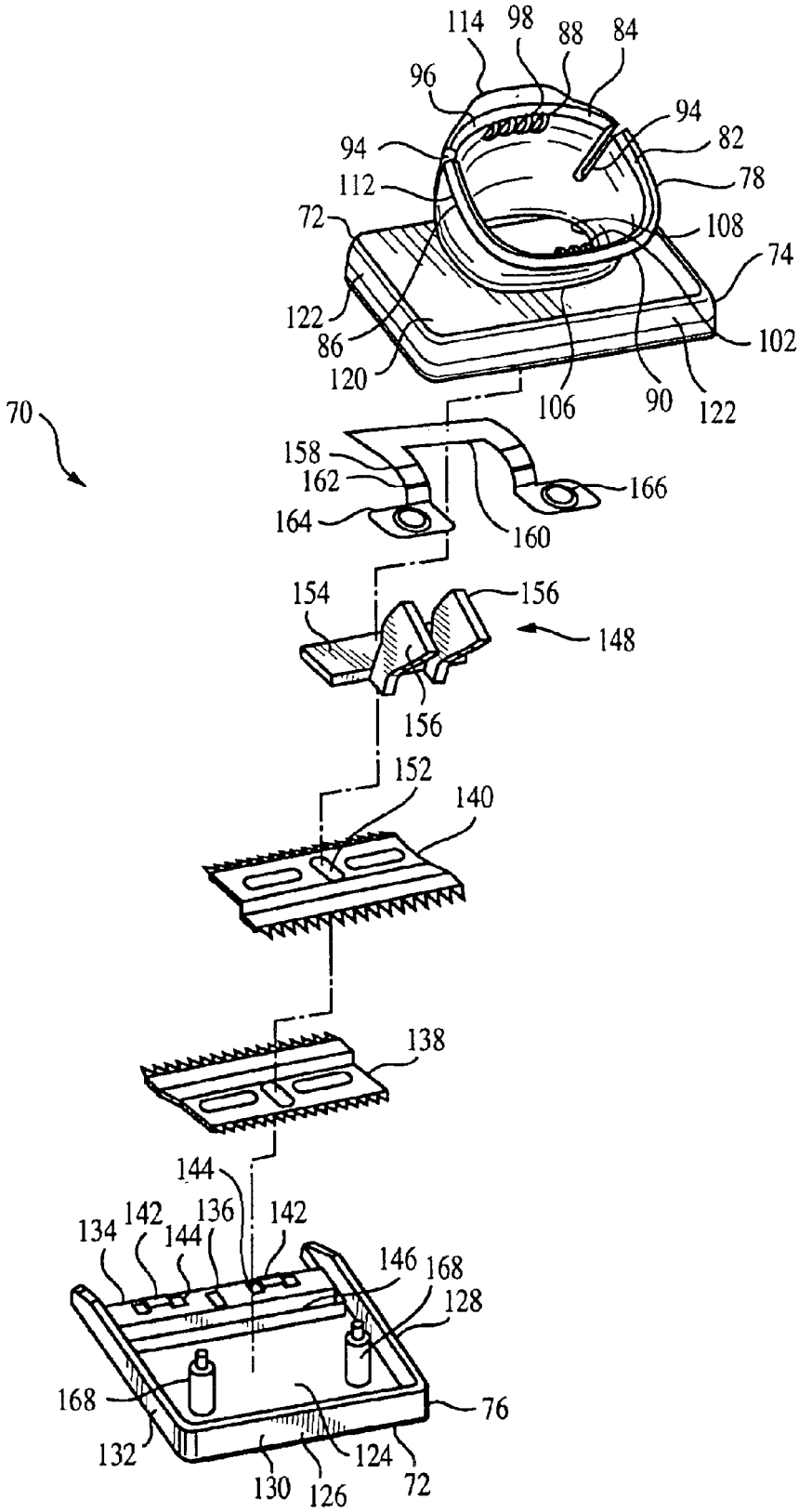
FIG. 3 is an exploded perspective view of the present detachable clipper blade assembly.

Referring now to FIG. 3, the floor 124 is generally inclined toward an open side 134 and is provided with a blade locating lug 136 which is preferably integrally formed with the floor 124. The lug 136 is preferably elongated in shape and has a longitudinal axis which is generally parallel to the sides 128 and 132. Furthermore, the lug 136 has a height preferably designed to be slightly taller than the cross-sectional thickness of a fixed blade 138 to maintain the blade in a fixed position on the floor 124. It is also contemplated that the lug 136 may be slightly shorter than the blade thickness, as long as the blade 138 is prevented from moving during the operation of reciprocating blade 140 which slides against fixed blade 138.

The arrangement and operation of the blades 138, 140 themselves are well known in the art. The preferred blades for the present invention are described in detail in commonly assigned U.S. Pat. No. 5,579,581, which is incorporated by reference herein.

Adjacent each side of the lug 136 is disposed a blade guide boss 142 which is secured to the floor 124 for guiding a reciprocating blade 140 relative to the fixed blade 138. The blade guide bosses 142 also have broad shaped bases 144 which aid in supporting and securing the fixed blade 138 in position on the floor 124. In the preferred embodiment, the blade guide bosses 142 are each preferably oriented at 90 degrees to the blade locating lug 136, and preferably have a relatively equal or greater height for engaging the moving blade 140 as will be described below. It is also preferred that the floor 124 be provided with a support rib 146 which projects vertically from the floor to support an underside of the fixed blade 138.

In addition to the first and second housing portions 74, 76, and the fixed and reciprocating blades 138, 140, the blade assembly 70 further includes a cam follower, generally designated 148, for engaging the drive actuator member 64 in the recess 80 in the second coupler formation 78. The orbital eccentric motion of the drive actuator member 64 is translated into reciprocating linear action at the reciprocating blade 140 by a blade driver lug 150 or similar formation (best seen in FIG. 4) which extends from the cam follower 148 and engages a central slot 152 on the blade 140. The lug 150 is preferably dimensioned to be tall enough to maintain engagement with the slot 152 without interfering with the upper end of the blade locating lug 136.

Referring now to FIGS. 3–5, the cam follower 148 preferably consists of a single integrally formed piece, fabricated by injection molding or equivalent technology. A generally rectangular and planar base 154 serves on an upper side as the attachment point of a cam follower formation 156. In shape, the formation 156 may be preferably generally forked to fit snugly onto the spherical drive actuator member 64 to form a ball joint and be driven thereby, while still permitting easy engagement and self-alignment of the blade assembly 70 without interfering with the driving action. An advantageous feature of the blade assembly 70 is that the actuator member 64 automatically aligns with the cam follower formation 156 as the first coupler formation 60 aligns itself with the second coupler formation 78 upon the snap locking engagement.

According to this preferred embodiment, the forked formation 156 is also long enough to project through the opening 108 and into the recess 80 of the second coupler formation 78. The cam follower formation 156 should thus also be generally disposed opposite a location on the base 154 from which depends the blade driver lug 150.

The cam follower formation 156 is held to the reciprocating blade 140 by a U-shaped cam follower clip 158 (best seen in FIGS. 3 and 4). The clip 158 is preferably formed of a stamped metal ribbon, but may also be formed of plastic, or any other resilient material known in the art. A flat portion 160 of the clip 158 is disposed along the cam follower planar base 154 and exerts a biasing force which holds the base 154 to the reciprocating blade 140. Side portions 162 of the clip 158 wrap around the cam follower formation 156. Ends 164 of the side portions 162 preferably include mounting holes 166 which, in the preferred embodiment, are heat welded to plastic clip mounts 168 that extend from the planar floor 124 of the second housing portion 76. The clip ends 164 may also be secured by adhesive, sonic welding, or other securing means known in the art. It is also contemplated that the clip ends 164 may be flat, with no mounting holes, and slidingly engage a slot or clip in the clip mounts 168. The clip 158 thus operates so that the reciprocating blade 140 will slidingly engage the fixed blade 86, and the blades 138, 140 will be biased against each other and the floor 124.

Next, the cam follower 148 is disposed upon the reciprocating blade 140 so that the blade driver lug 150 is inserted into the central slot 152. The lug 150, as well as the locator lug 136, is dimensioned to be tightly accommodated in the central slot 152 to prevent unwanted play in the blades 138, 140. The driver lug 150 does not engage the fixed blade 138. As the uppermost first housing portion 74 is lowered upon the reciprocating blade 140, the cam follower formation 156 passes through the opening 108 and extends into the recess 80 of the second coupler formation 78.

Once the first housing portion 74 is fastened to the lowermost second housing portion 76, the engagement of the clip 158 will exert a biasing force against the reciprocating blade 140, preferably through the flat portion 154 of the cam follower 148, to hold the blade 140 against the fixed blade 138, and also hold the fixed blade 138 against the floor 124 of the second housing portion 76. As best seen in FIG. 5, the blades 138, 140 are only partially enclosed by the housing 72 and project from the open side 134 to engage hair to be clipped.

The biasing force from the clip 158 is directed toward the floor 124, is generally normal to the axis of motion of the reciprocating blade 140, and urges the reciprocating blade 140 against the fixed blade 138. Although this biasing force is preferably exerted by the clip 158 in conjunction with the flat portion 154 of the cam follower 148, the flat portion of the cam follower 148 may instead be geometrically shaped, and, be formed of a material known in the art, to a exert its own spring biasing force against the blade 140, without the need for the clip 158.

Attachment of the blade assembly 70 to the handle portion 42 proceeds by engaging the second coupler portion 78 about the first coupler portion 60 of the handle portion 12. The spring-biased tab 96 spreads slightly to accommodate the insertion of the,first coupling portion 60, but then retracts as the protrusions 98, 102 snap into groove 100, 104 respectively to secure the components together. At the same time of full engagement, the forked cam follower formation 156 fits snugly upon the drive actuator member 64.

A significant advantage of the construction described above is that the operator may readily attach the self-aligning blade assembly 70 to the handle portion 42 by easily locating the tapered engagement opening 66 of the handle portion 42 into the larger first shroud opening of the blade assembly 70, and merely exert an axially directed pushing force upon the blade assembly 70 towards the handle portion 42. Unlike conventional fixed designs, no special alignment or manipulation is required to achieve proper engagement of the blade assembly 70 upon the handle 12 because the two components self-align. Additionally, alignment and engagement of both the blade assembly and the cam follower may be accomplished in a single operation.

Upon completion of the clipping operation, the operator or technician may place the clipper 40 near a disposal container. The tab 114 is pressed by the operator's thumb or finger in the direction of the indicator arrow 116, and the entire blade assembly 70 will pop off into the disposal container without requiring the operator to come in contact with the sharp blades or the, use of two hands. The extending shroud 78 length even further serves to prevent the operator's thumb from coming into contact with the blades should it happen to slip off the release tab 96. As discussed above, the prior art clippers with detachable heads require two hands or the touching of blades by the operator, which may expose the operator to contamination.

While a particular embodiment of the detachable fixed clipper blades of the invention has been shown and described, it will be appreciated by those skilled in the art that changes and modifications may be made thereto without departing from the invention in its broader aspects and as set forth in the following claims.

What is claimed is:

1. A hair clipper, comprising:

a handle portion having a drive end including a first coupler formation;

a blade assembly including a housing at least partially enclosing a reciprocating blade and a fixed blade, said housing having a top portion, a bottom portion, and at least two side portions connecting said top and bottom portions; and a second coupler formation for engaging said first coupler formation, wherein said second coupler formation integrally joins to and extends away from said bottom portion of said blade assembly housing, wherein said first and second coupler formations form a releasable connection, and wherein said releasable connection inhibits movement of said blade assembly with respect to said handle portion upon engagement of said first and second coupler formations.

2. The hair clipper as defined in claim 1, wherein said second coupler formation is a shroud with an internal shape configured to conform generally to an external shape of said first coupler formation.

3. The hair clipper as defined in claim 2, wherein said first and second coupler formations self-align said handle portion with said blade assembly when an engaging force is exerted between said coupler formations.

4. The hair clipper as defined in claim 3, wherein said internal and external shapes are tapered to facilitate self-alignment.

5. The hair clipper as defined in claim 3, wherein said internal and external shapes are generally untapered.

6. The hair clipper as defined in claim 1, wherein at least one of said first and second coupler formations includes at least one protrusion for engaging at least one groove on the other of said first and second coupler formations.

7. The hair clipper as defined in claim 1, wherein at least one of said first and second coupler formations is provided with release means for readily disengaging from the other of said first and second coupler formations.

8. The hair clipper as defined in claim 7, wherein said release means includes a tab projecting from a rim.

9. The hair clipper as defined in claim 7, further including indicator means on said release means for indicating the direction in which said release means is to be activated by a user to release said second coupler formation from said first coupler formation.

10. The hair clipper as defined in claim 1, wherein at least one of said first and second coupler formations is provided with at least one notch such that said at least one formation exerts a biasing force upon the other of said first and second coupler formations upon engagement.

11. The hair clipper as defined in claim 1, wherein said clipper includes a drive actuator member projecting from said drive end, and said blade assembly further includes a blade driver with a cam follower for engaging said drive actuator member, and a blade driving formation for engaging said reciprocating blade.

12. The hair clipper as defined in claim 11, wherein said blade driver further includes spring means for exerting a biasing force against said reciprocating and said fixed blades.

13. The hair clipper as defined in claim 11, wherein said cam follower has a forked configuration for engaging said drive actuator member and forming a ball joint with said drive actuator member, said drive actuator member having a generally spherical configuration.

14. A hair clipper, comprising:

a handle portion having a drive end with a first coupler formation; and a blade assembly including a housing at least partially enclosing a reciprocating blade and a fixed blade, and having a second coupler formation for engaging said first coupler formation to form a releasable connection which restricts movement of said blade assembly relative to said handle portion when said first and second coupler formations are engaged, and said releasable connection prevents physical contact between said handle portion and said housing of said blade assembly when engaged.

15. The hair clipper as defined in claim 14, wherein at least one of said first and second coupler formations is configured to exert a releasable biasing force upon the other of said first and second coupler formations.

16. The hair clipper as defined in claim 14, wherein one of said first and second coupler formations is provided with release means for readily disengaging from the other of said first and second coupler formations.

17. The hair clipper as defined in claim 14, wherein said handle portion includes a drive actuator member projecting from said drive end, and said blade assembly further includes a blade driver with a cam follower for engaging said drive actuator member, and a blade driving formation for engaging and moving said reciprocating blade, said drive actuator passing through said connection to engage said blade driver.

18. A disposable blade assembly for use with a hair clipper, the clipper including a handle having a drive end, a drive member extending from the drive end, and a coupler formation disposed at the drive end, the disposable blade assembly comprising:

a housing having a top portion, a bottom portion, and at least two side portions joining said top and bottom portions;

blade locating means disposed on an interior of said top portion;

a fixed cutting blade being configured for engagement on said blade locating means;

a movable cutting blade being configured for reciprocal linear movement relative to said fixed cutting blade;

a shroud formation defining a recess for accommodating the drive member, said recess having a first opening integrally connected to a central opening in said housing bottom portion, and a second opening opposed to said first opening, said second opening for engaging the coupler formation of the drive member; and cam follower means for engaging said drive member through said first opening in said shroud formation and for exerting a biasing force on said fixed and movable cutting blades, said recess having an irregular shape which restricts movement of the engaged coupler formation.

19. The blade assembly as defined in claim 18, wherein the drive member is spherical in shape, and said cam follower means has a generally forked shape for engaging said drive member.

20. The blade assembly as defined in claim 18, wherein an interior of said shroud formation is shaped to generally conform to an exterior of said coupler formation, and said shroud formation includes a tab formation for facilitating release of said assembly from said drive end.

21. The blade assembly as defined in claim 18, wherein said cam follower means includes at least one spring means associated therewith for exerting said biasing force on said blades.

22. The blade assembly as defined in claim 18, wherein an area of said second opening is smaller than an area of said housing bottom portion.

23. The blade assembly as defined in claim 22, wherein an area of said first opening is smaller than said area of said second opening.

24. A hair clipper, comprising:

a handle portion having a drive end with a first coupler formation;

a blade assembly including a housing at least partially enclosing a reciprocating blade and a fixed blade, and having a second coupler formation for engaging said first coupler formation, said first and second coupler formations forming a connection which restricts movement of said blade assembly relative to said handle portion upon engagement;

at least one of said first and second coupler formations is provided with release means for readily disengaging from the other of said first and second coupler formations, said release means including a tab projecting from said at least one coupler formation for facilitating one-handed release by a user.

* * * * *